US008192012B2

(12) United States Patent
Domoto et al.

(10) Patent No.: US 8,192,012 B2
(45) Date of Patent: Jun. 5, 2012

(54) PROCESS AND APPARATUS FOR INK JET ULTRAVIOLET TRANSFUSE

(75) Inventors: Gerald A. Domoto, Briarcliff Manor, NY (US); Donald M. Bott, Rochester, NY (US); Stephan Drappel, Ontario (CA)

(73) Assignee: Xerox Corporation, Norwalk, CT (US)

( * ) Notice: Subject to any disclaimer, the term of this patent is extended or adjusted under 35 U.S.C. 154(b) by 18 days.

(21) Appl. No.: 12/852,508

(22) Filed: Aug. 8, 2010

(65) Prior Publication Data

US 2010/0295913 A1 Nov. 25, 2010

Related U.S. Application Data

(62) Division of application No. 11/291,284, filed on Nov. 30, 2005, now Pat. No. 7,789,502.

(51) Int. Cl.
*B41J 2/01* (2006.01)

(52) U.S. Cl. ..... 347/102

(58) Field of Classification Search ..... None
See application file for complete search history.

(56) References Cited

U.S. PATENT DOCUMENTS 6,332,679 B1 * 12/2001 Higuma et al. ..... 347/102
6,670,981 B1 * 12/2003 Vincent et al. ..... 347/264

* cited by examiner

*Primary Examiner* — Stephen Meier
*Assistant Examiner* — Alexander C Witkowski
(74) *Attorney, Agent, or Firm* — Marger Johnson & McCollom PC

(57) ABSTRACT

In a tonerless imaging process, an inked image layer jetted on an image receptor is simultaneously transferred and fused to a recording medium. A radiation-curable material is incorporated in the image layer such that irradiation of the image layer cures the radiation-curable material therein. An ink jet printing apparatus for performing the above process is also disclosed.

7 Claims, 4 Drawing Sheets

FIG. 4
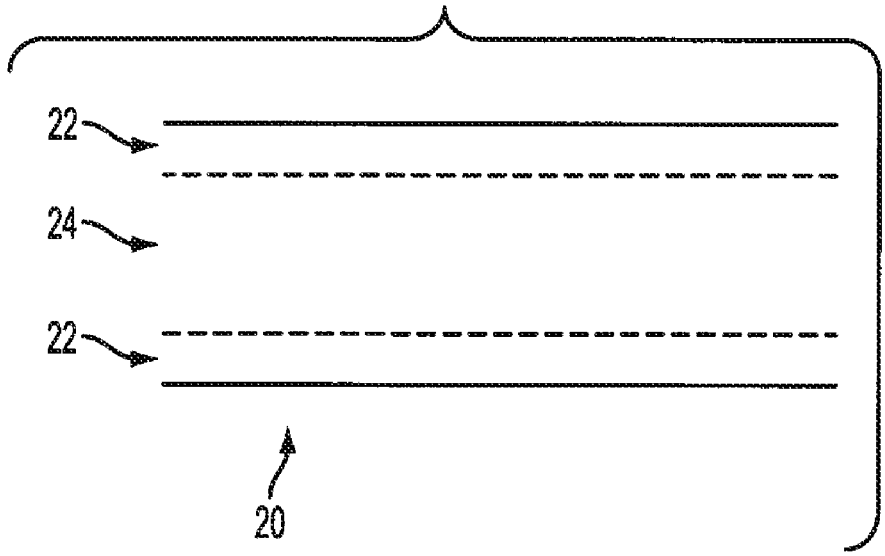
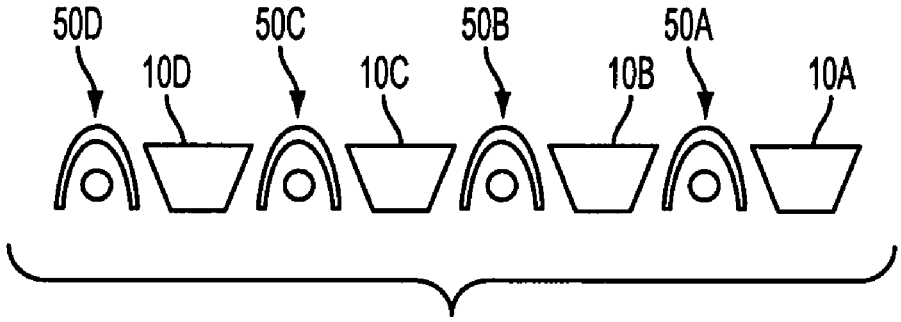
FIG. 5

PROCESS AND APPARATUS FOR INK JET ULTRAVIOLET TRANSFUSE

CROSS-REFERENCE TO RELATED APPLICATIONS

This is a Division of co-pending U.S. patent application Ser. No. 11/291,284, filed Nov. 30, 2005, entitled PROCESS AND APPARATUS FOR INK JET ULTRAVIOLET TRANSFUSE, the disclosure of which is herein incorporated by reference in its entirety.

BACKGROUND

The present disclosure relates to an ink jet printing device and method for transferring and fusing an image layer from an image receptor to a recording medium, such as paper, and more specifically to forming an ultraviolet radiation-curable image on an image receptor and transfusing the formed image from the image receptor to a recording medium.

Imaging processes may be used to develop black and white, single color, or multi-color images. Multi-color imaging may be done either as a fully-formed image or a step-formed image. A fully-formed image implies that an image with multiple colors is fully formed on the image receptor and then transferred to the recording medium in a single step. In a step-formed image, the colored images are individually formed on the image recorder and transferred to the recording medium one color at a time.

A method of transferring an image from an image receptor to a recording medium, U.S. Pat. No. 5,212,526, comprises electrostatically depositing toner to form a toned image layer on a surface of an image receptor, the toned image layer including a toner material and a radiation-curable material. Toners are typically amorphous or semicrystalline materials having broad melting temperature ranges. A recording medium is contacted with the toned image layer, and the toned image layer is irradiated in contact with the recording medium to cure the radiation-curable material. The resulting cured material is disclosed to have greater adhesion to the toner material and the recording medium than to the surface of the image receptor. In this method, the image receptor is made of a dielectric material to facilitate the uniform electrostatic charge of conventional xerography or ionography.

BRIEF DESCRIPTION OF THE DRAWINGS

FIG. 4 is a diagram of an alternative image receptor embodiment as described herein.

FIG. 5 is a diagram of an alternative embodiment wherein an ultraviolet radiation source is interposed between image generators.

DETAILED DESCRIPTION

Figure 1:
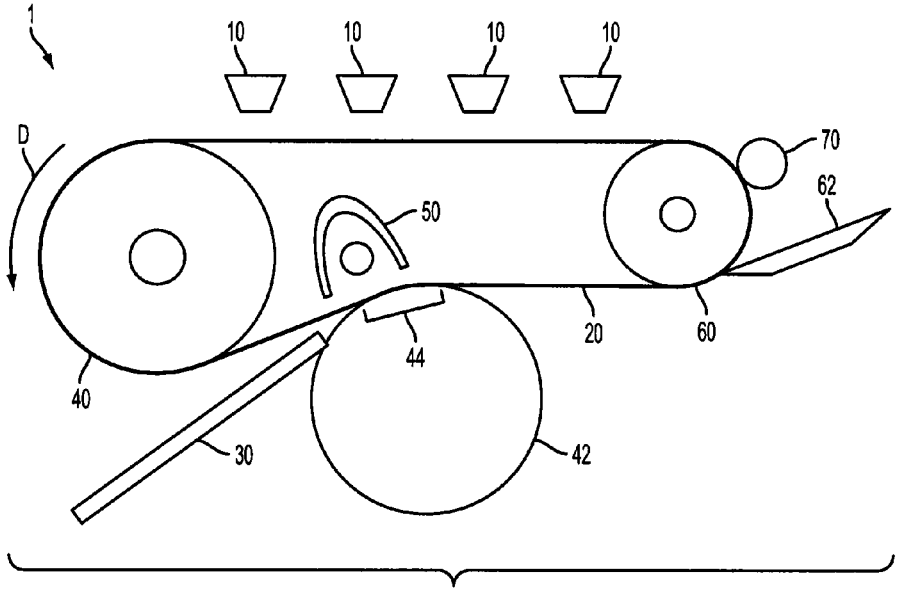
FIG. 1 is a diagram of a first embodiment of a printing apparatus as described herein.

Turning to the exemplary embodiment of FIG. 1, an ink jet printing device 10 has one or more image generators 10 in the form of printheads. In this embodiment, printheads 10 are structured to jet or otherwise emit one or more ink compositions to form an image layer. Hot melt or phase change ink compositions are generally crystalline materials with sharp melting points, viscosity lower than toners at typical fusing temperatures. The printheads 10 may be disposed to form the image layer on either of an image receptor 20 or a recording medium 30, described below.

A standard ink jet printing device typically has one printhead, with the image layer formed by the printhead 10 emitting ink drops during multiple ink jetting passes over the image receptor 20. Such interlacing techniques are known in the printing art. Alternatively, a plurality of printheads 10 can be utilized to jet inks in a single pass of the image receptor 20 or recording medium 30.

It is contemplated that the present printing device can employ phase-change ink compositions; that is, solid ink compositions that are converted to liquid to facilitate jetting and image layer formation, then returned to solid phase. Such inks are intended herein to be uncharged, in that they are jetted dropwise onto the image receptor 20 or recording medium 30 without the need for electrostatic or ionographic charge to guide ink placement. At least one ink accessible by the image generator 10 has therein a material curable upon exposure to ultraviolet radiation. Ink compositions and exemplary materials are discussed in greater detail below.

The printing apparatus can produce a printed image on numerous types of recording media 30, such as paper of various stock and size, transparency, and other materials.

A recording medium feeder (not shown) generally is provided to manipulate the recording medium 30 as necessary or desired to orient the medium for the formation/transfer of the image layer thereto.

The image receptor 20 of this embodiment is a belt disposed to travel in direction D around rollers 40, 60, but may alternatively be a web, drum, plate or sheet. The image receptor 20 is positioned to have formed thereon a image layer by an image generator 10, which can be one or more printheads, ink drop emitting apparatuses or other means for producing an image layer.

A radiation-curable material is added to the ink composition used in forming the image layer. The material of the image receptor 20 of this embodiment therefore is substantially translucent to an ultraviolet radiation wavelength selected to cure the radiation-curable material within the image layer.

The image receptor 20 belt of FIG. 1 preferably is structured to accept the inked image layer while also permitting efficient transfer of the image layer to the recording medium 30. To that end, it is preferred that the surface of the image receptor 20 have a slight roughness sufficient to permit adherence of the ink compositions used in the image generator(s) 10. An overly rough image receptor 20 surface, however, will interfere with efficient transfer of the image layer from the image receptor 20 to the recording medium 30. The degree of surface roughness of image receptor 20 can be optimized in concert with the specific ink compositions and recording media 30 chosen for use in the printing device.

In describing the first embodiment, it is instructive to view the journey taken by a formed image as a print path. The print path may be but is not necessarily defined by the image receptor 20 or by the recording medium 30. Rather, it is the inked image layer itself that defines the print path as it travels, in the embodiment of FIG. 1, from the image receptor 20 to the recording medium 30.

By illustrative example, the image receptor 20 belt of this embodiment is moved around tensioning rollers 40, 42, 60 in the indicated direction. In other embodiments, various other means for translocating the image receptor 20 belt may be employed. In an alternative embodiment having a drum, for example, it will be appreciated that the drum may be rotated by use of rollers, gears, drive belts, or other means.

Figure 2:
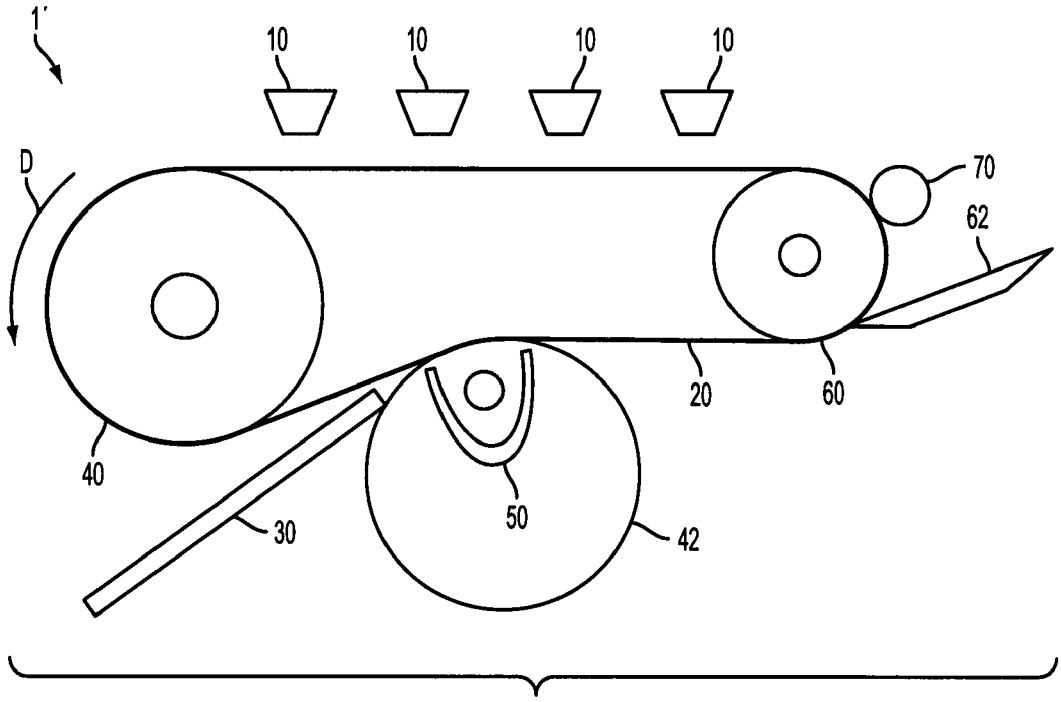
FIG. 2 is a diagram of a second embodiment of a printing apparatus.
Figure 3:
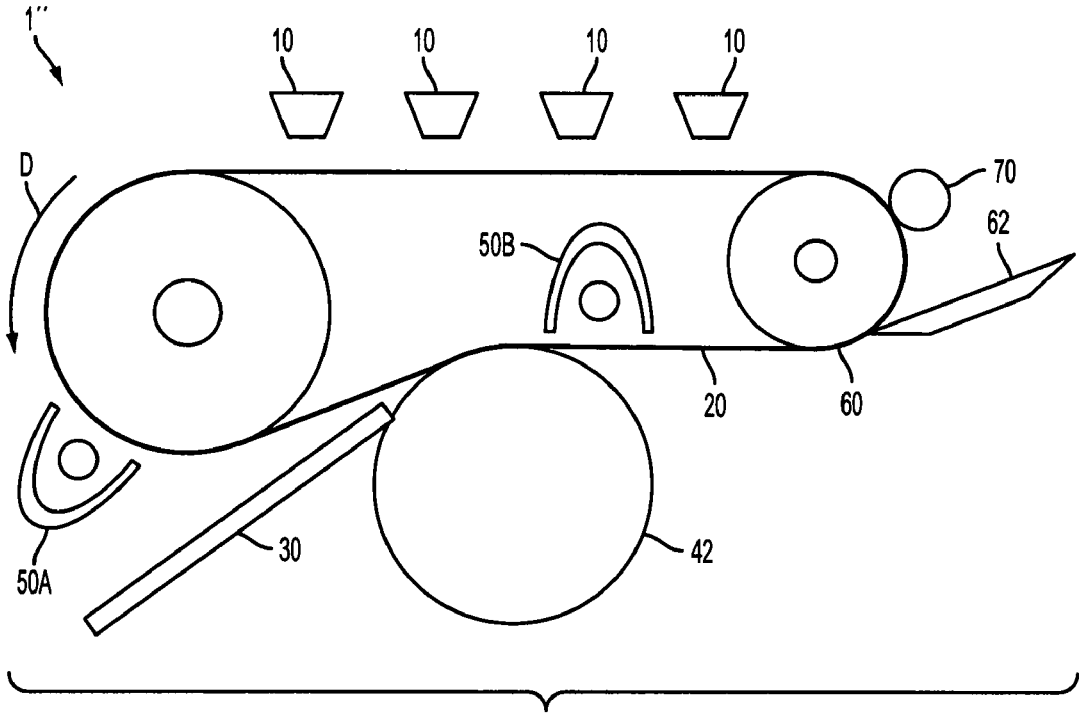
FIG. 3 is a diagram of a third embodiment of a printing apparatus.

Continuing with the embodiment of FIGS. 1-3, the nip 44 is the portion of the print path where the image layer is contacted with the image receptor 20 to transfer the image layer to the recording medium 30. The backing roller 42 and image receptor 20 define the nip 44. The backing roller 42 can be biased against the image receptor 20 with a selected pressure.

The image layer, which is carried on the image receptor 20 belt once formed by the image generator 10, and the recording medium 30 are translocated toward the nip. When the image layer on the image receptor contacts the recording medium at the nip, the image layer is transferred from the image receptor to the recording medium.

At one or more points along the print path, the image layer can be exposed to radiation from an ultraviolet radiation source 50. The intensity and specific wavelength(s) of the ultraviolet radiation are capable of at least partially curing the radiation-curable material, which increases ink viscosity in the image layer upon exposure to the radiation. The strength and specific frequency or frequencies of ultraviolet radiation can be selected based on image layer thickness, substrate, nature of radiation-curable material, and other factors.

In this embodiment, the ultraviolet radiation source 50 thus is positioned to irradiate the image layer through the image receptor 20 while the image layer is in contact with the recording medium 30. The radiation source 50 is positioned behind the image receptor 20 area contacting the recording medium 30, which is held against the image receptor 20 by the backing roll 42.

In an alternative embodiment, the ultraviolet radiation source 50 may be disposed within the backing roller 42 (FIG. 2) for cases in which the recording medium is transparent to the ultraviolet radiation. If a drum is employed as the image receptor instead of the image receptor belt 20 of FIG. 1, the ultraviolet radiation source 50 may alternatively be disposed within the drum 20 (not shown).

Turning to FIG. 4, an alternative embodiment image receptor 20 structure is shown, comprising peripheral regions 22 bounding a central image region 24. The image region 24 is substantially translucent to ultraviolet radiation of at least the selected wavelength(s). An image receptor 20 belt of this construction may advantageously provide structural rigidity or mechanical characteristics at the edges thereof 22 (which may be achieved through use of ultraviolet radiation-opaque materials, for example) while retaining a substantially ultraviolet radiation-translucent image region 24. The ultraviolet radiation source 50 alternatively may be oriented to irradiate the region 24 of image receptor 20 upon which the image layer is disposed, to at least partially cure the image layer, while it is on the image receptor 20 and before it contacts the recording medium 30.

The first embodiment apparatus 1 has the ultraviolet radiation source 50 disposed to expose the radiation-curable material to ultraviolet radiation substantially contemporaneously with the image layer contacting the recording medium 30. The radiation-translucent portion of the image receptor 20 permits ultraviolet radiation to pass there through and affect the radiation-curable material in the image layer. Upon exposure to the curing radiation, the radiation-curable material at least partially or fully hardens and fuses the image layer to the recording medium 30.

If desired, the ultraviolet radiation can be focused in order to irradiate one or more predetermined loci on the image receptor 20 or recording medium 30. It will be appreciated that the ultraviolet radiation system can include a plurality of ultraviolet irradiators transmissively coupled to a single ultraviolet radiation source. In such a system, a plurality of fiber-optic, reflecting, or other means convey ultraviolet radiation from the ultraviolet radiation source to the plurality of ultraviolet irradiators.

Irradiation of the image layer prior to contact with the recording medium permits the ink of the image layer to be at least partially cured before transfer. Such at least partial curing of the image layer may be used to control the viscosity of the image layer. That is, a low-viscosity ink composition may be utilized for ready jetting, and the ink then irradiated with ultraviolet radiation to increase ink viscosity in the image layer. A more viscous ink makes the image layer components more positionally stable and minimizes print quality defects due to running or merging of inks in the image layer.

In a case where a low-viscosity ink composition is used, it may be desirable to partially cure the ink in the image layer rapidly subsequent to ink jetting. FIG. 5 shows an embodiment wherein a plurality of ultraviolet radiation sources 50A, 50B, 50C and 50D are interposed with printheads 10A, 10B, 10C and 10D, permitting relatively immediate irradiation of an ink jetted from each printhead 10A, 10B, 10C and 10D in the nascent image layer.

The radiation-curable material will at least partially harden as it is cured by ultraviolet radiation. Upon ultraviolet radiation-induced polymerization, the radiation-curable material solidifies and adheres to the recording medium 30. The radiation-curable material should in a preferred embodiment require no additional thermal energy to penetrate the paper fibers, although such thermal energy may be employed if desired. Also, the material preferably requires no additional high pressure to flow into and wet the recording medium 30 fibers (if a recording medium having fibers is utilized). Because the process may involve transferring and fusing the image layer in a single step, the printing method disclosed herein does not require additional heat or pressure in the transfer step, and the printing apparatus 1 has both a lowered energy need and reduced mechanical/thermal stress.

The ultraviolet radiation level, frequency and beam shape requirements affect image processing rates and are generally dependent on the concentration and type of photoinitiator, In still a third arrangement (FIG. 3), a plurality of ultraviolet radiation sources 50 may be employed to irradiate the image layer at a plurality of path points. As shown, a first ultraviolet radiation source 50 is positioned to irradiate the image layer on the image receptor 20 prior to contact with the recording medium 30, and a second ultraviolet radiation source 50 is positioned to irradiate the image layer on the recording medium as it exits the nip. The second ultraviolet radiation source 50 could efficaciously be positioned to irradiate the recording medium 30 within the nip, or a third ultraviolet radiation source 50 could be disposed to so irradiate the recording medium 30.

A stripping roller 60 and/or stripper 62 can be provided to remove residual image layer from the image receptor 20. A stripping roller 60 generally is a small-diameter roller designed to induce an acute curve into a belt-type image receptor 20. Flexure of the image receptor 20 belt loosens image layer materials from adhesion to the image receptor and facilitates removal therefrom.

The stripper 62 similarly functions to remove image layer residue from the image receptor 20 by scraping, abrading, or otherwise lifting such residue.

Suitable radiation-curable materials for incorporation into ink compositions are disclosed in U.S. Pat. Nos. 4,056,453; 4,026,949; 3,804,736; and 3,803,109, the disclosures of each of which are totally incorporated herein by reference. Among the radiation-curable materials which may be used are the polyfunctional terminally unsaturated organic compounds including the polyesters of ethylenically unsaturated acids such as acrylic acid and methacrylic acid and a polyhydric alcohol. Examples of some of these polyfunctional compounds are the polyacrylates and polymethacrylates of trimethylolpropane, pentaerythritol, dipentaerythritol, ethylene glycol, triethylene glycol, propylene glycol, glycerin, sorbitol, neopentylglycol, 1,6-hexanediol and hydroxyterminated polyesters, hydroxy-terminated epoxy resins, and hydroxy-terminated polyurethanes. Also included in this group of terminally unsaturated organic compounds are polyallyl and polyvinyl compounds such as diallyl phthalate and tetraalyloxyethane and divinyl adipate, butane divinyl ether and divinylbenzene.

Another group of radiation-curable compounds are polyfunctional ethylenically unsaturated compounds that are not terminally unsaturated, but these materials tend to be less reactive than the terminally unsaturated compounds.

In addition to the multifunctional ethylenically unsaturated material, a monofunctional one may also be used for the radiation-curable material. Thus, 0-90% by weight of a monofunctional ethylenically unsaturated material may be added for viscosity control, cured film flexibility and bond strength. A preferred group of such radiation-curable compounds are the terminally unsaturated organic compounds containing one terminal ethylenic group per molecule. Examples of such monofunctional compounds are the $C_2$ to $C_{16}$ alcohol esters of acrylic and methacrylic acid, styrene, and substituted styrenes, vinyl esters such as vinyl acetate, vinyl ethers and N-vinyl 2-pyrrolidone. In general, these compounds are liquid and have lower viscosity than the polyfunctional compounds and thus can be used to reduce the viscosity of the coating composition.

To enhance transfer of the formed image layer from the image receptor 20 to the recording medium 30, a release agent may be applied to the image receptor 20. The particular release agent used may be selected based on the structure of the image receptor 20, the composition of the inks used to form the image layer, the composition of the inks available to the image generator (irrespective of whether such ink is used to form the image layer), or other considerations.

A release agent may be added to the ink composition or the image receptor to give the proper surface energy characteristics for the partially cured material. A release agent may be selected from any available release agent used in developing processes which insures the transfer and fusion of inks image from the image receptor to the recording medium. Examples of release agents include without limitation water, fluorinated oils, glycol, surfactants, mineral oil, silicone oil, functional oils or combinations thereof.

The ink composition generally contains one or more colorants. The coloring may be provided by pigment particles, or may comprise a resin and a pigment; a resin and a dye or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga. Ontario. Morfast Blue 100, Red 101, Red 104, Yellow 102, Black 101, Black 103, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like.

Additional components may be added to the ink composition such as solvents, stabilizers, photoinitiators, and the like.

The first embodiment printing device 10 may be used to make black-and-white, single color, or multi-color images. A multi-color image may be produced wherein the image layer is fully formed on the image receptor before transferring the image layer to the recording medium. Alternatively, a multi-color image may be produced wherein each color is separately transferred from the image receptor to the recording medium. In either process, the image layer or a color layer therein may be at least partially cured at various stages in the process.

In a simplified process, a tonerless image layer is jetted on the image receptor belt using one or more ink compositions of low viscosity. The tonerless image layer then is irradiated with ultraviolet radiation to at least partially cure the inks in the image layer.

The at least partially cured image layer then is transferred to a recording medium, shown as paper herein. Transfer, as shown here, is effected by bringing the image layer on the image receptor into contact with the recording medium. Pressure is applied to the recording medium to bias it against the image layer and improve transfer of the inks in the image layer to the recording medium, although such pressure is not necessary. In an alternative method, the image layer may be exposed to thermal energy (via the image receptor, recording medium, or via ambient delivery). It is preferred that thermal energy not be necessary to efficacious transfer and fusion of the image layer to the recording medium.

After transfer and fusing of the tonerless image layer to the recording medium, the recording medium may be irradiated with ultraviolet radiation to substantially fully cure the image layer thereon. Substantially complete curing fuses or fixes the inked image onto the recording medium.

At the point of transfer and fusion, the image receptor of FIG. 1 is positioned between the radiation source and the recording medium. The image receptor therefore should allow the ultraviolet radiation to pass through and onto the image layer to cure the radiation-curable material in the image layer.

The paths of the moving image receptor and recording medium then separate between tensioning rollers, and the recording medium is ejected from the printing apparatus. The image receptor belt typically is cleaned between tensioning rollers and/or stripper(s) in preparation for further image processing.

The transfused image preferably will have the surface finish of the recording medium. The surface of the recording medium may be further regenerated, treated or modified, for example, by roughening.

In one embodiment of the method, substantially fully cured ink is more readily removed from the image receptor in preparation for a next image layer to be jetted thereon. In alternative method embodiments using different ink compositions, the residual ink on the image receptor may be more easily removed if not substantially fully cured. In such embodiments, it is desirable to substantially completely cure the ink of the image layer transferred to the recording medium but preserve the residual ink of the image layer on the image receptor in an uncured state.

It will be appreciated that various of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The invention claimed is:

1. A method for tonerlessly printing an image, comprising:

jetting a tonerless inked image layer at an image layer region on a first side of an image receptor, the tonerless inked image layer including an ultraviolet radiation-curable ink component; and irradiating the tonerless inked image layer with ultraviolet radiation from an ultraviolet radiation source.

2. The method of claim 1, further comprising:

transferring the tonerless inked image layer from the image receptor to a recording medium; and fully curing ultraviolet radiation-curable component by irradiating the tonerless inked image layer with ultraviolet radiation from an ultraviolet radiation source.

3. The method of claim 1, further comprising transferring the image layer from the image receptor to a recording medium;

wherein the image receptor is one of a belt, a web, a drum, a plate or a sheet and at least the image layer region thereof is substantially translucent to ultraviolet radiation; and wherein irradiating the tonerless inked image layer with ultraviolet radiation comprises irradiating the tonerless inked image layer with ultraviolet radiation from a second side of the image receptor, at least a portion of the ultraviolet radiation traveling from the ultraviolet radiation source through the image receptor to the tonerless inked image layer.

4. The method of claim 3 wherein irradiating the image layer with ultraviolet radiation comprises irradiating the image layer with ultraviolet radiation prior to transferring the image layer.

5. The method of claim 1, further comprising transferring the tonerless inked image layer from the image receptor to a recording medium, the recording medium biased against the tonerless inked image layer by a backing roller substantially translucent to ultraviolet radiation; and wherein irradiating the image layer with ultraviolet radiation comprises irradiating the image layer with ultraviolet radiation, at least a portion of the ultraviolet radiation traveling from the ultraviolet radiation source through the backing roller to the tonerless inked image layer.

6. The method of claim 1, further comprising:

transferring the tonerless inked image layer from the image receptor to a recording medium;

wherein irradiating the image layer with ultraviolet radiation comprises irradiating the image layer with ultraviolet radiation substantially contemporaneous with transferring the tonerless inked image layer.

7. The method of claim 1 wherein irradiating the image layer with ultraviolet radiation comprises at least partially curing the ultraviolet radiation-curable component in the image layer.

* * * * *